US005191661A

United States Patent [19]

Chang

[11] Patent Number: 5,191,661

[45] Date of Patent: Mar. 9, 1993

[54] CONTROL DEVICE FOR A WATER TANK

[76] Inventor: Fong C. Chang, No. 72, Minli St., Taichung City, Taiwan

[21] Appl. No.: 755,431

[22] Filed: Sep. 5, 1991

[51] Int. Cl.[5] ..... E03D 3/12

[52] U.S. Cl. ..... 4/324; 4/325; 4/412; 4/415

[58] Field of Search ..... 4/324, 325, 378, 379, 4/381, 382, 395, 396, 405, 412, 415

[56] References Cited

U.S. PATENT DOCUMENTS

| | | | |
|---|---|---|---|
| 4,216,555 | 8/1980 | Detjen | 4/324 |
| 4,651,359 | 3/1987 | Battle | 4/324 |
| 4,748,699 | 6/1988 | Stevens | 4/324 |
| 4,937,895 | 7/1990 | Stevens | 4/324 |

*Primary Examiner*—William A. Cuchlinski, Jr.
*Assistant Examiner*—W. Morris Worth
*Attorney, Agent, or Firm*—Leonard Bloom

[57] ABSTRACT

A control device including an inlet pipe and an outlet pipe disposed in the water tank, a valve disposed on top of the outlet pipe, a pawl rotatably supported on top of the inlet pipe, a float slidably engaged on the inlet pipe, a pusher extended downward from the float, the float will be caught by the pawl when the float moves downward, the outlet pipe will be closed by the valve after all of the water has been discharged, and the float will not be caught by the pawl when the knob is released right after depression so that the float may move downward to push the valve.

2 Claims, 3 Drawing Sheets

CONTROL DEVICE FOR A WATER TANK

BACKGROUND OF THE INVENTION

1. Field of the Invention

The present invention relates to a control device, and more particularly to a control device for a water tank.

2. Description of the Prior Art

Typical water tanks, particularly flush tanks, include an outlet valve from which water may flow out for flushing purposes. Generally, the water volume flowing out of the flush tank is predetermined and can not be adjusted so that the same amount of water will be discharged whenever the outlet valve is opened. This wastes water because, in some cases, the water volume required is less than the predetermined volume.

The present invention has arisen to mitigate and/or obviate the afore-described disadvantages of the conventional control devices for water tanks.

SUMMARY OF THE INVENTION

The primary objective of the present invention is to provide a control device for water tanks in which the discharged water volume can be adjusted.

In accordance with one aspect of the invention, there is provided a control device for a water tank including an inlet pipe and an outlet pipe disposed in the water tank, a valve disposed on top of the outlet pipe, a block fixed on top of the inlet pipe, a hanger laterally extended from the block, a pawl having a middle portion rotatably supported on the hanger and having a hook formed in one end, a float slidably engaged on the inlet pipe, a catch laterally extended from the float, a pusher extended downward from the float, a lever having a knob formed in one end, the other end of the lever can be caused to move upward when the knob is depressed, a cable coupled between the other end of the lever and the other end of the pawl so that the pawl can be caused to rotate from one position to the other position where the hook of the pawl is located below the catch of the float, and another cable coupled between the valve and the other end of the lever so that the valve can be pulled open when the other end of the lever moves upward and so that water contained within the water tank can be discharged via the outlet pipe, the float will be lowered when the water discharges out through the outlet pipe, the catch of the float will be caught by the hook of the pawl when the float moves downward and when the knob is depressed for a short period of time, so that the valve will move downward to close the outlet pipe after almost all of the water contained within the water tank has been discharged, and the catch of the float will not be caught by the hook of the pawl when the knob is released right after depression operation thereof so that the float may move downward along the inlet pipe and so that the valve can be caused to move downward in order to close the outlet pipe.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
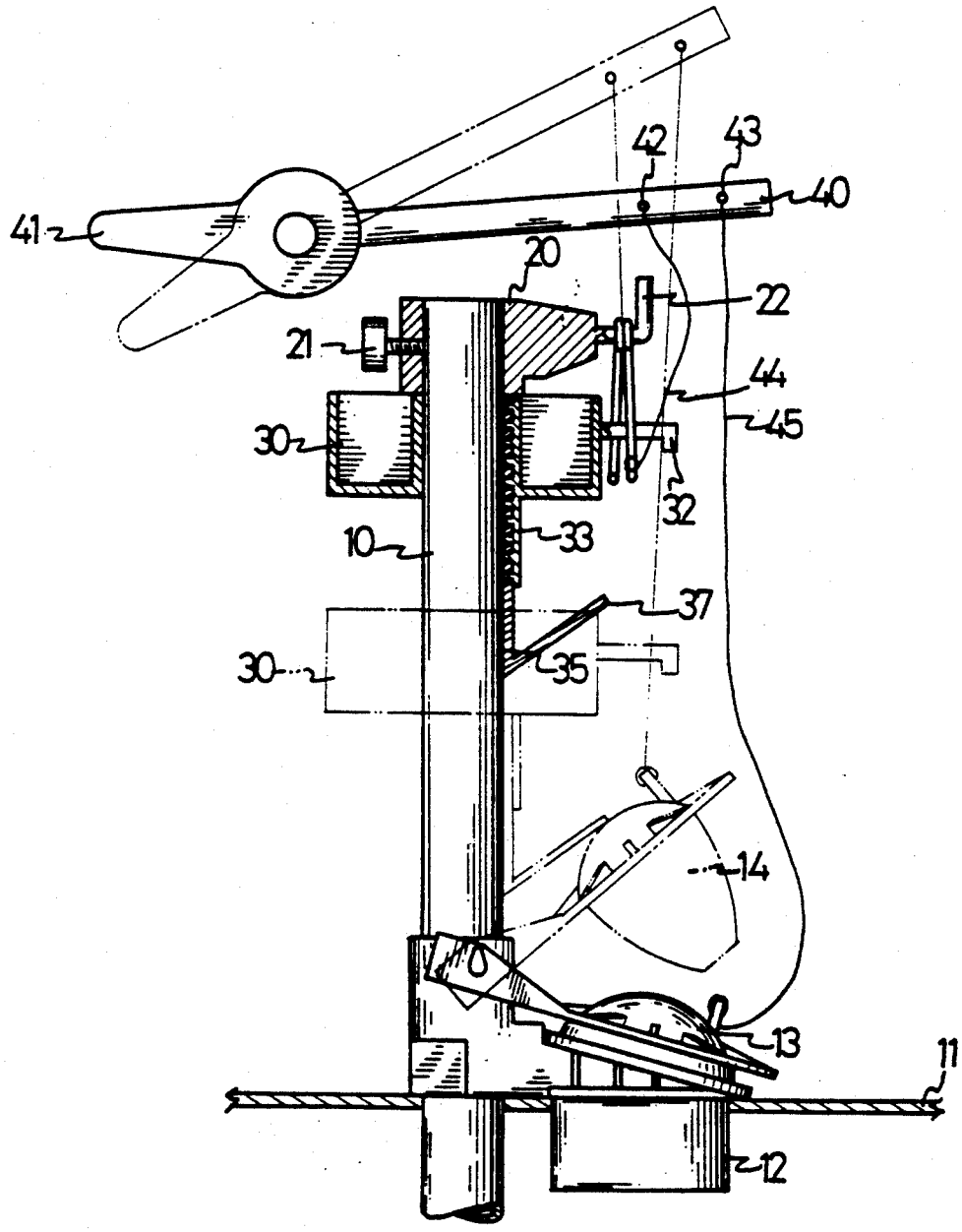
FIG. 1 is a schematic view illustrating the control device for water tanks in accordance with the present invention.
Figure 2:
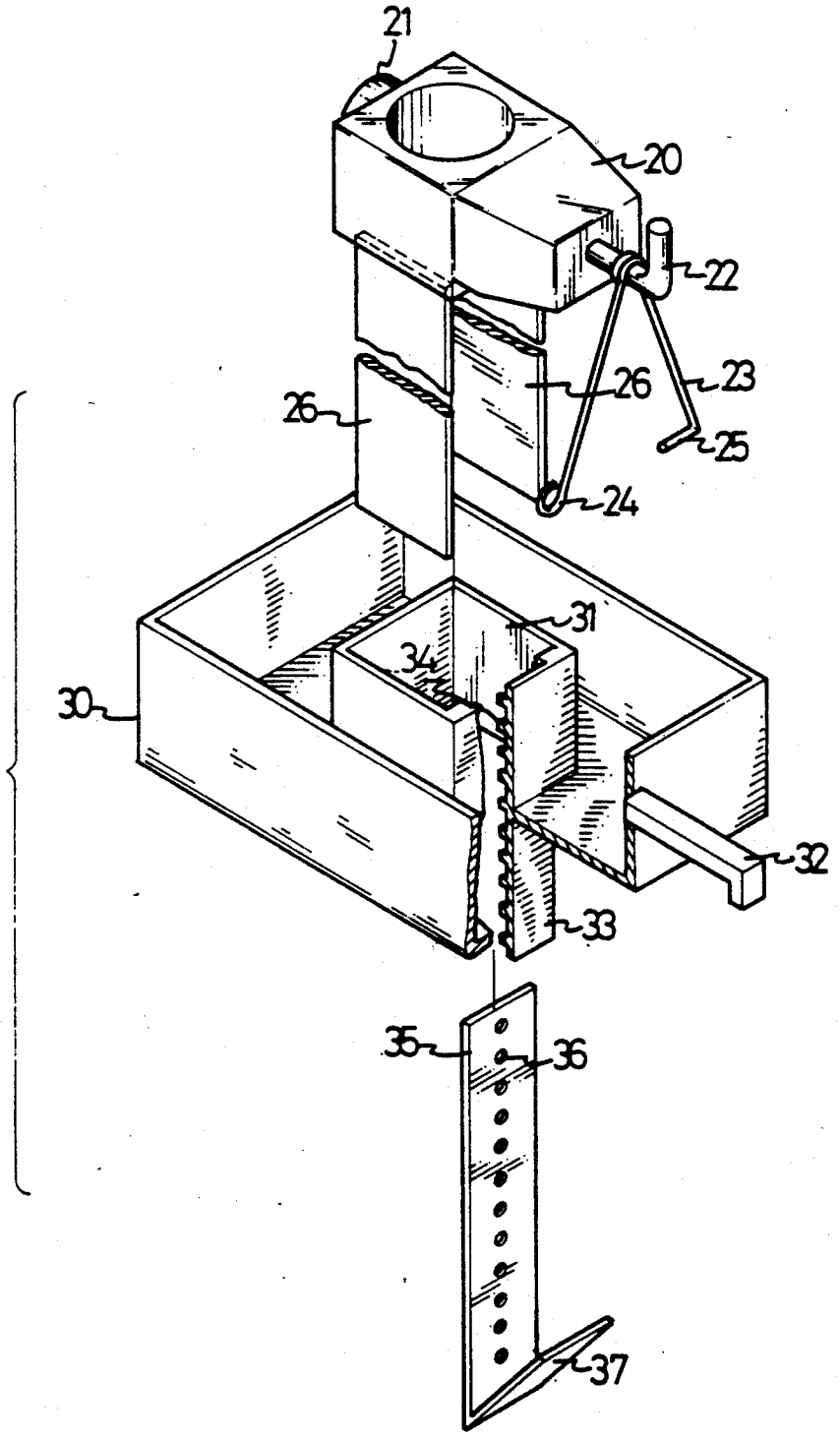
FIG. 2 is a partial exploded view of the control device for water tanks.

Referring to the drawings and initially to FIGS. 1 and 2, a control device in accordance with the present invention comprises generally an inlet pipe 10 connected to a reservoir (not shown) for supplying water to the water tank 11 in which the control device is disposed, an outlet pipe 12 disposed in the bottom of the tank 11, a valve 13 disposed for controlling the opening and closing operations of the upper end of the outlet pipe 12, the valve 13 includes a float 14 which is received in the outlet pipe 12 when the valve 13 is in a close position, and the float 14 is buoyed upward by the water contained within the tank 11 when the valve 13 is in an open condition, in which water flows outward of the outlet pipe 12 when the valve 13 is opened.

A block 20 is fixed on top of the inlet pipe 10 by a bolt 21. A hanger 22 is fixed on one end of the block 20. A pawl 23 which has a middle portion rotatably engaged on the hanger 22 includes a hook 25 formed on a first end and a loop 24 formed on a second end thereof. A pair of plates 26 are oppositely fixed on the side portions of the block 20 and extended downward from the block 20. The plates 26 are slidably engaged on the inlet pipe 10.

A float 30 is made of light weight materials, such as plastic material so that the float 30 can be buoyed upward by the water contained within the water tank 11 and includes a substantially rectangular opening 31 formed in the center portion thereof so that the float 30 can be slidably engaged on the plates 26 of the block 20. A catch 32 extends laterally from the float 30. An extension 33 extends downward from the first side surface of the opening 31. A plurality of protrusions 34 are formed on the extension 33 and the first side surface of the opening 31 and are preferably aligned. A pusher 35 includes a plurality of holes 36 formed therein for engagement with the protrusions 34 of the float 30 and an element 37 formed on the bottom thereof. The element 37 is preferably a bent portion of the pusher 35. The pusher 35 can be adjusted upward and downward relative to the float 30 by the engagement between the protrusions 34 and the holes 36.

A lever 40 has a middle portion pivotally supported on the water tank 11 and is preferably located above the inlet pipe 10. The lever 40 includes a knob 41 formed in a first end and two apertures 42, 43 formed in the second end thereof. The knob 41 is reachable from outside of the water tank 11. A cable 44 has one end threaded through the aperture 42 and has the other end coupled to the loop 24 of the pawl 23. Another cable 45 has one end threaded through the aperture 43 and has the other end coupled to the valve 13.

Figure 3:
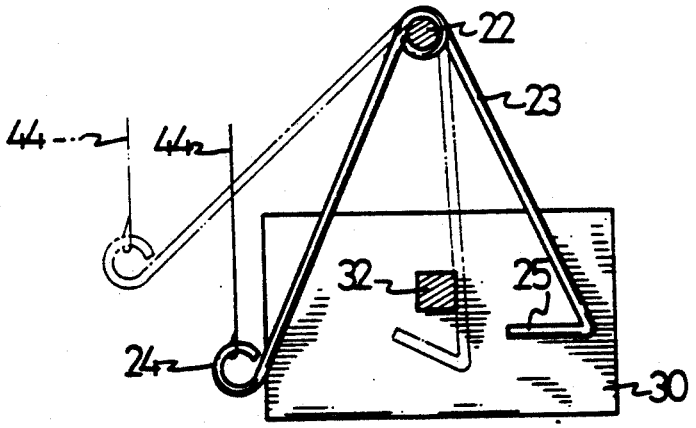
FIG. 3 is a schematic view illustrating the operations of the control device.

In operation, referring next to FIG. 3 and again to FIG. 1, when it is required to discharge the water contained within the water tank, the knob 41 is pressed downward in order to elevate the second end of the lever 40 such that the valve 13 can be opened and such that the water contained within the water tank 11 can flow out through the outlet pipe 12, the float 14 will be buoyed by the water contained within the water tank 11 so that the valve 13 can be maintained in the open position; simultaneously, the pawl 23 can be caused to rotate about the hanger 22 and is rotatable from the first position as shown in solid lines to the second position as shown in dotted lines (FIG. 3), so that the hook 25 can be caused to move to the position located below the catch 32. When the knob 41 is maintained in the downward position for about three to five seconds, i.e., the knob 41 is still pressed downward by the user, the water level contained within the water tank 11 will be lowered and the float 30 will also be lowered such that the catch 32 will be caught by the hook 25 and such that the float 32 will not further move downward. At this moment, the knob 41 can be released. The valve 13 will move downward to close the outlet pipe 12 when almost all of the water contained within the water tank 11 has been discharged.

It is to be noted that the pawl 23 will be maintained in the first position (solid lines, FIG. 3) by gravity when the knob 41 is not pressed downward by the user, such that the pawl 23 will be recovered to the first position when the float 32 is caused to move upward again by the water filled into the tank 11.

However, when it is required to discharge only part of the water contained within the water tank, the knob 41 is also pressed downward by the user, however, the knob 41 should be released within about three seconds, preferably released right after depression operation, before the catch 32 is caught by the hook 25, accordingly, the float 30 moves downward when the water level is lowered. The valve 13 will be depressed to close the outlet pipe 12 by the element 37 of the pusher 35 before all of the water contained within the water tank 11 has been discharged. When the pusher 35 is adjusted downward relative to the float 30, the distance between the element 37 and the float 30 is increased such that the water volume flowing out of the water tank 11 will be decreased.

Accordingly, the discharged water volume of the water tank controlled by the control device in accordance with the present invention can be adjusted.

Figure 4:
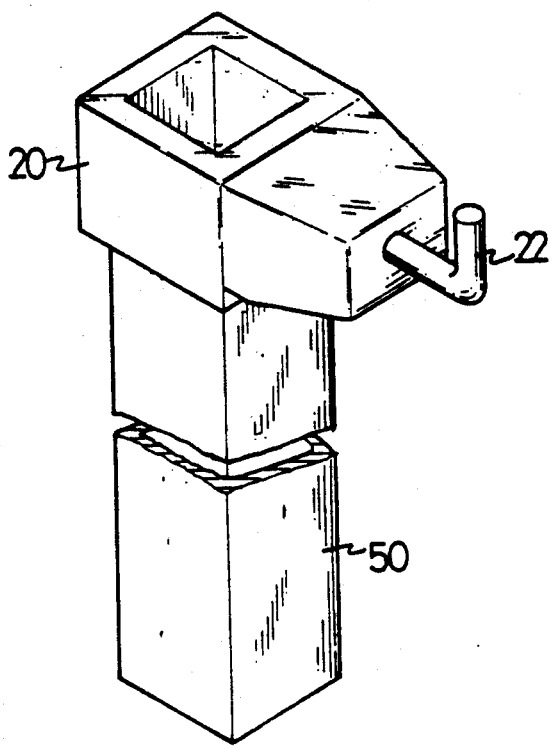
FIG. 4 is a perspective view illustrating another embodiment of the present invention.

Alternatively, as shown in FIG. 4, the inlet pipe 50 can be formed integral with said block 20 and can be formed by such as molding processes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A control device for a water tank comprising an inlet pipe and an outlet pipe disposed in said water tank, a valve disposed on top of said outlet pipe, a block fixed on top of said inlet pipe, a hanger laterally extended from said block, a pawl having a middle portion rotatably supported on said hanger and having a hook formed in a first end thereof and including a second end, a first float slidably engaged on said inlet pipe and movable upward and downward along said inlet pipe, a catch laterally extended from said first float, a pusher extended downward from said first float and located above said valve and moving in concert with said first float, said valve being actuated by said pusher when said pusher and said first float move downward along said inlet pipe, said first float including an opening formed in a center thereof, said opening including a plurality of protrusions formed in one side surface thereof, said pusher including a plurality of holes formed therein for receiving said protrusions of said first float so that said pusher can be adjusted upward and downward relative to said first float, a lever having a middle portion pivotally supported in an upper portion of said water tank and having a knob formed in a first end thereof and including a second end which is movable upward when said knob is depressed downward, said knob being reachable from outside of said water tank, a first cable second end of said pawl so that, when said second end of said lever moves upward, said pawl can be caused to rotate from a first position to a second position where said hook of said pawl is located below said catch of said first float, and a second cable coupled between said valve and said second end of said lever so that said valve can be pulled open when said second end of said lever moves upward and so that water contained within said water tank can be discharged via said outlet pipe, said first float will be lowered when said water discharges out through said outlet pipe, said catch of said first float will be caught by said hook of said pawl when said first float moves downward and when said knob is depressed for a short period of time, so that said valve will move downward to close said outlet pipe after almost all of said water contained within said water tank has been discharged, and said catch of said first float will not be caught by said hook of said pawl when said knob is released right after depression operation thereof so that said first float may move downward along said inlet pipe and so that said valve can be caused to move downward in order to close said outlet pipe.

2. A control device for a water tank comprising an inlet pipe and an outlet pipe disposed in said water tank, a valve disposed on top of said outlet pipe, a block fixed on top of said inlet pipe, a hanger laterally extended from said block, a pawl having a middle portion rotatably supported on said hanger and having a hook formed in a first end thereof and including a second end, a first float slidably engaged on said inlet pipe and movable upward and downward along said inlet pipe, said first float including an opening formed in a center thereof, said opening of said first float being rectangular, a pair of plates extending downward from said block and opposite with each other, said opening of said first float being slidably engaged on said plates of said block so that said first float can be guided to move up and down along said plates, a catch laterally extended from said first float, a pusher extended downward from said first float and located above said valve and moving in concert with said first float, said valve being actuated by said pusher when said pusher and said first float move downward along said inlet pipe, a lever having a middle portion pivotally supported in an upper portion of said water tank and having a knob formed in a first end thereof and including a second end which is movable upward when said knob is depressed downward, said knob being reachable from outside of said water tank, a first cable coupled between said second end of said lever and said second end of said pawl so that, when said second end of said lever moves upward, said pawl can be caused to rotate from a first position to a second position where said hook of said pawl is located below said catch of said first float, and a second cable coupled between said valve and said second end of said lever so that said valve can be pulled open when said second end of said lever moves upward and so that water contained within said water tank can be discharged via said outlet pipe, said first float will be lowered when said water discharges out through said outlet pipe, said catch of said first float will be caught by said hook of said pawl when said first float moves downward and when said knob is depressed for a short period of time, so that said valve will move downward to close said outlet pipe after almost all of said water contained within said water tank has been discharged, and said catch of said first float will not be caught by said hook of said pawl when said knob is released right after depression operation thereof so that said first float may move downward along said inlet pipe and so that said valve can be caused to move downward in order to close said outlet pipe.

* * * * *